United States Patent [19]

Salmond et al.

[11] 4,401,209

[45] Aug. 30, 1983

[54] SPECTACLE CASE

[75] Inventors: Andrea Salmond; Patricia St. John, both of Long Beach; Randall A. Luebke; Jeffrey B. Van Tassel, both of Huntington Beach, all of Calif.

[73] Assignee: Rods and Cones, Inc., Long Beach, Calif.

[21] Appl. No.: 303,730

[22] Filed: Sep. 21, 1981

[51] Int. Cl.[3] ..... A45C 11/04

[52] U.S. Cl. ..... 206/5; 206/37; 206/349; 206/460

[58] Field of Search ..... 206/5, 6, 39, 37, 419, 206/418, 349, 460

[56] References Cited

U.S. PATENT DOCUMENTS

| | | | |
|---|---|---|---|
| 2,966,985 | 1/1961 | Morris | 206/5 R |
| 3,225,922 | 12/1965 | Straight | 206/419 |
| 3,280,969 | 10/1966 | Evans et al. | 206/349 |
| 3,851,762 | 12/1974 | Liblick | 206/460 |
| 4,267,923 | 5/1981 | Baratelli et al. | 206/5 |

*Primary Examiner*—William T. Dixson, Jr.
*Attorney, Agent, or Firm*—Thomas I. Rozsa

[57] ABSTRACT

The present invention is related to an improved spectacle case which is capable of securely retaining a spectacle within it. Utilization of this improved spectacle case assures that the spectacle will not move within the case, even if the case is jostled. The spectacle case is capable of retaining a spectacle within it in such a fashion that the exterior surfaces of the lenses never come in contact with the case. The unique design of the case also prevents the temples of the spectacle from coming in contact with the interior surface of the lenses. The unique configuration of the spectacle case gives it vastly improved strength over presently used spectacle cases.

25 Claims, 5 Drawing Figures

SPECTACLE CASE

BACKGROUND OF THE INVENTION

Spectacles are worn by humans in order to correct defects in vision. A common pair of spectacles consists of two lenses. Each lens is encased in a rim or frame front which serves to support it. The two rims are connected by a bridge. A temple is hinged to the outward edge of each rim or frame front. When worn, the bridge extends over the wearer's nose and the tip of each temple passes over the wearer's ears. In recent years, various modifications such as the elimination of the rims has been achieved. At the minimum, however, a spectacle must contain two lenses attached by a bridge, with hinged temple attached to each of the external sides of the rim or frame front.

While a tremendous amount of research and development has gone into improving the design of lenses and the general appearance of the spectacle, very little development has been made in the cases which hold and protect the spectacle when it is not being worn. The basic design of the spectacle case has remained relatively unchanged. The ordinary "soft" case is essentially an elongated pouch into which the folded spectacle is slid. Each temple is folded so that the tip of each temple rubs against the interior surface of the opposite lens, and in this fashion the spectacle is slid into the "soft" case. As a result, the exterior surface of each lens rubs against the interior of the "soft" spectacle case while the interior surface of each lens rubs against the tip of the temple. As a result, both the interior and exterior surfaces of the lenses can be scratched. The "soft" case also offers little protection for the glasses if they should accidentially be dropped or stepped on, or sat on, while they are in the "soft" case.

The ordinary "hard" spectacle case is a container which allows folded glasses to be placed inside it. The container consists of a base, two sides, a central bridge support, and a foldover top which covers the spectacle and can be snapped shut. In order to be placed in the case, the spectacle must be folded in the same manner as described above for insertion into a "soft" spectacle case. The spectacle is placed inside the "hard" case such that the bridge rests on the central bridge support, with the temples resting on the base. The folding top is then snapped shut over the spectacle. The temples once again rub against the interior surface of the lenses. The top of the case rubs against the exterior surface of the lenses. As a result, both the interior and exterior surfaces of the lenses become scratched. While the "hard" case offers greater protection than the "soft" case and can usually protect the spectacle if it is dropped while in the case, even the "hard" case usually cannot protect the spectacle if the case is accidentally stepped on or sat on. In addition to these two problems which the "hard" case shares with the "soft" case, the "hard" case also causes undue tension against the bridge of the spectacle. The spectacle is forced to rest against the central bridge support and over a period of time, this can cause the bridge to be worn and loosened. In addition, the spectacle nose supports which are directly behind the bridge can also be loosened and worn. This problem necessitates costly repairs and adjustments.

In addition to the above mentioned problems, both the "soft" and the "hard" spectacle cases are inconvenient to carry. If placed in a shirt or coat pocket, they cause the pocket to bulge and appear unsightly. Further, there is additional rubbing of both interior and exterior lens surfaces by the spectacle case and the temples while the individual is walking. If carried in a purse, the spectacle case is jostled against other objects in the purse while the individual is walking, with the same result of scratched lenses.

Therefore, although many improvements have been made in spectacle frames and lenses over the past century, relatively little improvement has been made in spectacle cases. Although embellished with attractive colors and attractive design features, the basic structure of both the "soft" and "hard" spectacle case has remained relatively unchanged. Soft material has been placed on the inside of the cases to reduce the incidence of scratched lenses, but this has not eliminated the scratching on the exterior surface of the lenses. The temples still rub against the interior surface of the lenses. Although the strength of each type of case has been improved to protect the spectacles if the case should be dropped, neither case can withstand a heavy force such as someone accidentally stepping on the case or sitting on the case. If such a force should occur, the spectacle inside would be severely damaged.

SUMMARY OF THE INVENTION

The present invention is related to an improved spectacle case which is capable of securely retaining a spectacle within it. Utilization of this improved spectacle case assures that the spectacle will not move within the case, even if the case is jostled inside a purse or subject to other forces when worn in a coat pocket or shirt pocket of a moving person.

The present invention further relates to an improved spectacle case which is capable of retaining a spectacle within it in such a fashion that the exterior surfaces of the lenses never come in contact with the case. As a result, the risk of scratching the exterior surface of the lenses while in the spectacle case is eliminated.

The present invention also relates to an improved spectacle case in which the temples of the spectacle are prevented from coming in contract with the interior surface of the lenses. As a result, the risk of scratching the interior surface of the lenses when the spectacle is placed in the case is eliminated.

The present invention additionally relates to an improved spectacle case design accompanied by use of a strong material which will give the spectacle case vastly improved strength over presently used spectacle cases. Utilization of the present invention provides a spectacle case which is capable of withstanding vastly increased pressure from external forces. As a result, the spectacle inside will not shatter or crack when the case is dropped, stepped on, or sat on.

The present invention also relates to an improved spectacle case which allows the spectacle to be firmly held within the case without putting stress on any portion of the spectacle. As a result, the bridge and nose support portions of the spectacle are not loosened by undue stress which is a problem encountered in presently used "hard" spectacle cases in the prior art.

The present invention is based on the realization that in order to avoid any possible scratching of the exterior or interior surface of the lenses, it is necessary to prevent the exterior lens surface from coming in contact with any portion of the spectacle case and it is further necessary to prevent the temples of the spectacle from coming in contact with the interior surface of the lenses.

Additionally, the present invention is based on the realization that spectacle cases in the prior art, both "soft" spectacle cases and "hard" spectacle cases, have structural designs which are inherently weak. As a result, even a modest external force can cause damage to the spectacle within. The present invention incorporates a one piece design which is comparable to a small house. As a result, the case can withstand far greater external forces and protect the spectacle within. Additionally, the present invention incorporates the use of Butyrate for the case material. Use of this material gives the spectacle case vastly improved structural strength and enables it to protect the spectacle even if the case is dropped, stepped on or sat on.

It has been discovered, according to the present invention, that if a spectacle case is designed in one piece in the shape of a house with a horizontal base, vertical walls, and a sloping arced roof, the inherent design is structurally far stronger that the design in prior art spectacle cases. This design enables the case to withstand severe external forces such as being dropped, stepped on, and sat on.

It has additionally been discovered, according to the present invention, that if the spectacle case is made of a strong material such as Butyrate, the case gains even greater strength to withstand the pressure from external forces.

It has further been discovered, according to the present invention that if the upper surface (or roof) of the improved spectacle case is curved such that each half of the upper surface forms a section of an arc with the highest point in the middle of the case, then the spectacle case has an upper surface which will come in contact only with the frame front of the spectacle or a very thin portion of the lens of spectacles that do not have a frame front. As a result, the spectacle is supported within the spectacle case by the frame front of the spectacle or a tiny lens portion in a spectacle without a frame front. Therefore, no portion of the exterior surface of the lenses comes in contact with the spectacle case (or only a tiny portion for rimless spectacles) and therefore the risk of scratching the exterior surface of the lens is eliminated.

It has been further discovered, according to the present invention, that if one vertical wall of the improved spectacle case is curved inwardly near the base and has an extension which runs parallel to the base, the spectacle case achieves a friction fit which retains the spectacles firmly inside. More specifically, if the gap between the extension and the base to which it runs parallel is approximately three thirty-seconds (3/32nds) of an inch thick, the tip of each temple can be slid into the gap area while the lenses and the frame front remain outside the gap area. As a result, a strong friction fit on the tip of each temple is achieved to securely retain the spectacle within the case. This eliminates the need for any other structure inside the case and therefore eliminates any stress problem on the bridge and the nose support pieces. Further, the temples are blocked by the inward extension of the vertical wall of the case and as a result do not touch the interior surfaces of the lenses. The temples rest against one side of the inward extension portion and the interior portion of the frame front rests on the other side of the inward extension. Therefore, the lenses are completely protected and this eliminates the risk of scratching the interior surface of the lenses by the temples.

It has additionally been discovered, according to the present invention, that the use of a one piece design made of a material such as Butyrate enables the cases to be extruded and facilitates economical mass production of the improved spectacle case.

It is therefore an object of the present invention to provide an improved spectacle case which is capable of securely retaining a spectacle within it such that the spectacle will not move within the case even if the case is jostled by external forces.

It is a further object of the present invention to provide a spectacle case which is capable of retaining a spectacle within it in such a fashion that the exterior surface of the lenses never come in contact with the case and therefore the risk of scratching the exterior surface of the lenses is eliminated.

It is another object of the present invention to provide a spectacle case in which the temples of the spectacle never come in contact with the interior surfaces of the lenses and therefore the risk of scratching the interior surfaces of the lenses is eliminated.

It is still another object of the present invention to provide a spectacle case in which the spectacle is retained within the case by friction of the frame front and the tip of each temple against surfaces of the spectacle case, thereby eliminating any stress against the bridge and the nose pieces of the spectacle.

It is still another object of the present invention to provide a spectacle case design which will give the spectacle case vastly improved strength in order to enable the case to withstand strong external forces such as being dropped, stepped on and sat on, and thereby protect the spectacle inside.

It is a further object of the present invention to provide a spectacle case of one piece design which will facilitate economical mass production.

Further novel features and other objects of the present invention will become apparent from the following detailed description and appended claims taken in conjunction with the drawings.

DRAWING SUMMARY

Referring particularly to the drawings for the purposes of illustration only and not limitation there is illustrated:

DETAILED DESCRIPTION OF THE PREFERRED EMBODIMENT

The present invention relates to an improved spectacle case which is capable of withstanding far greater external forces than spectacle cases of the prior art design. The present invention also relates to an improved spectacle case which is capable of securely retaining the spectacle within it by friction means without putting undue stress on any portion of the spectacle. The present invention additionally relates to an improved spectacle case which is capable of securely retaining a spectacle while eliminating any risk of scratching either the exterior or interior surfaces of the lenses.

Figure 1:
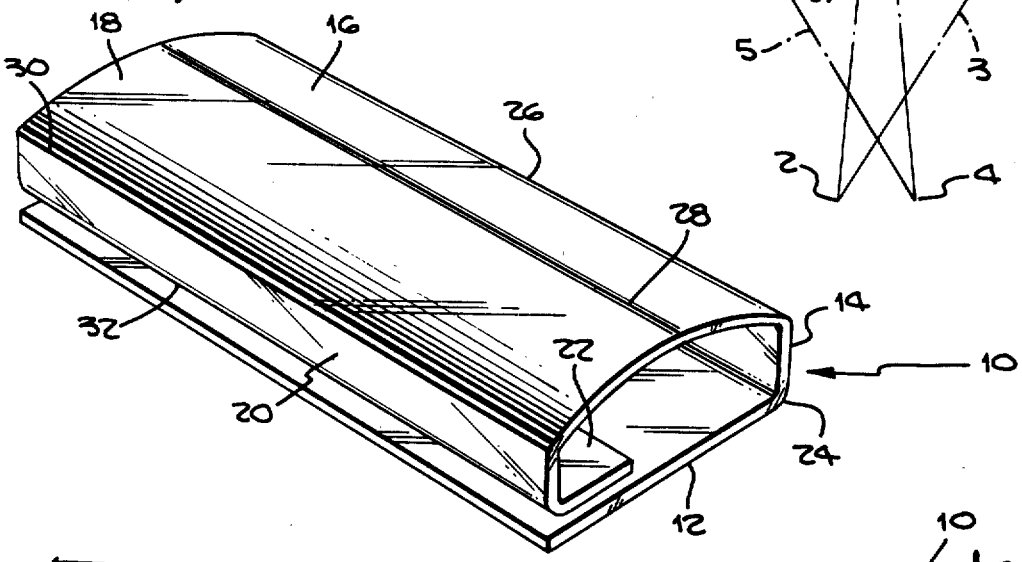
FIG. 1 is a perspective view of the preferred embodiment of the improved spectacle case.

With reference to the drawings of the invention in detail and more particularly to FIG. 1, there is shown at 10 the preferred embodiment of the improved spectacle case. The improved spectacle case 10 consists of a base 12, a first vertical wall 14, a first arced upper surface 16, a second arced upper surface 18, a second vertical wall 20, and an inward extension 34. The entire improved spectacle case 10 is made of one piece construction.

Figure 2:
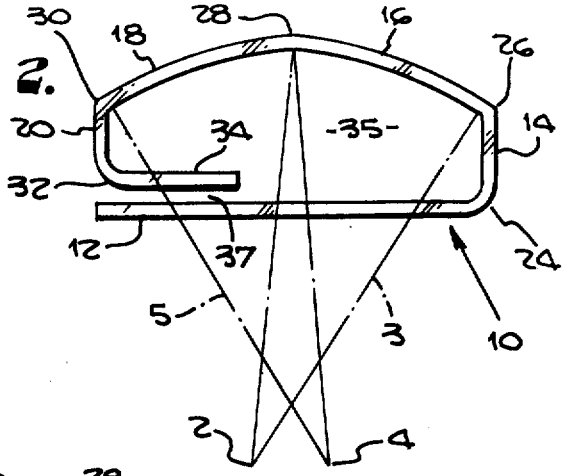
FIG. 2 is an end view of the preferred embodiment of the improved spectacle case.

With reference to FIG. 2, the base 12 and the lower portion of first vertical wall 14 are joined at curved portion 24. Were it not for the curve at 24, base 12 and first vertical wall 14 would be at right angles. The upper portion of first vertical wall 14 and the outermost portion of first arced upper surface 16 are joined at 26. The arc of first arced upper surface 16 has an imaginary center at 2 and extends from point 26 to uppermost point 28. Second arced surface 18 extends from uppermost point 28 to point 30 where it joins second vertical wall 20. The arc of second arced upper surface 18 has an imaginary center at 4. The radius of first arced upper surface 16 is shown at 3. The radius of second arced upper surface 18 is shown at 5. Radii 3 and 5 are equal in length. Second vertical wall 20 extends from point 30 but does not reach base 12. Instead, second vertical wall 20 is curved inwardly and extends along inward extension 34. Second vertical wall 20 and inward extension 34 meet at point 32. Inward extension 34 runs parallel to base 12 and inward extension 34 runs the entire length of improved spectacle case 10.

In the preferred embodiment, the vertical distance between inward extension 34 and base 12 is approximately three thirty-seconds of an inch. In the preferred embodiment, the length of base 12 is approximately two and three-quarter inches, the length of first vertical wall 14 measured from the bottom of base 12 to point 26 is approximately three quarters of an inch, and the length of second vertical wall 20 measured from point 30 to the lower portion of inward extension 34 is approximately nine sixteenths of an inch. The length of radius 3 is approximately two and fifteen sixteenths inches and the length of radius 5 is approximately two and fifteen sixteenths inches. The vertical distance from the bottom of base 12 to point 28 is approximately one and one quarter inches. The horizontal distance from point 30 to point 28 is approximately one and three eights inches and is equal to the horizontal distance from point 26 to point 28. Inward extension 34 extends inwardly for approximately one inch. The length of the improved spectacle case is approximately six inches.

Although described in detail section by section, the improved spectacle case 10 can also be viewed as a rectangular sheet member that is bent into five longitudinal sections, with the fifth section partially overlapping the first section. The first section 12 forms a flat base 12 which is wider than the vertical height of the frame front of a spectacle case 10. The second section 14 extends essentially perpendicular to the first section and has a height slightly less then the thickness of the spectacle when in its folded position. Although in the preferred embodiment the upper section is composed of two arcs 16 and 18, it is also possible to form the spectacle case 10 with one upper section (16 and 18 combined) which is essentially perpendicular to second section 14 and generally parallel to base 12, and being convexly curved in the direction away from said base 12. The fourth section 20 extends from said third section (16 and 18 combined), but does not extend to said base 12, leaving a gap 33 therebetween. The fifth section 34 extends inwardly from said fourth section 20 and parallel to said flat base 12, thereby forming a partial separation wall which partially separates the interior of the improved spectacle case into a chamber 35 and a gap area 37.

In the case of a spectacle without a frame front first section 12 forms a flat base which is wider than the vertical height of the lens of a spectacle without a frame front to be housed within said improved spectacle case 10.

In the preferred embodiment, the improved spectacle case 10 is made of Butyrate. It is desirable to have the Butyrate uniformly of three thirty-seconds of an inch in thickness. Other materials such as polycarbonate or acrylic, and other plastic based materials can also be used. It is important that the spectacle case 10 be made out of resilient material so that the fifth section 34 which forms a separation wall can deflect away from base 12 so as to frictionally retain the temples of a spectacle when it is inserted into the spectacle case.

From the end view of FIG. 2, it can be seen that first section or base 12, second section or first vertical wall 14, third section or first arced surface 16 and second arced upper surface 18, fourth section or second vertical wall 20, and fifth section or inward extension 34 form a spectacle case which is in the design of a small house. This design provides inherent strength and superior structural strength to the spectacle case. A spectacle case 10 of this design and manufactured out of Butyrate can easily withstand the force of being stepped on or sat upon by a two hundred pound man, thereby completely protecting the glasses or spectacle contained within it.

Figure 3:
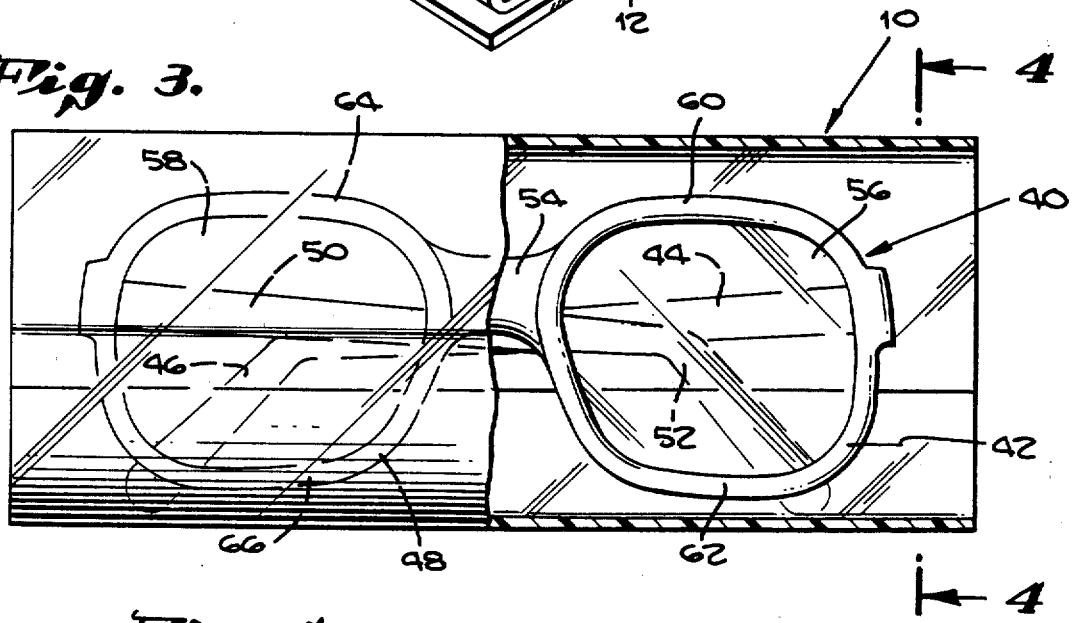
FIG. 3 is a top plan view of the improved spectacle case, partially in section, with a spectacle inserted.
Figure 4:
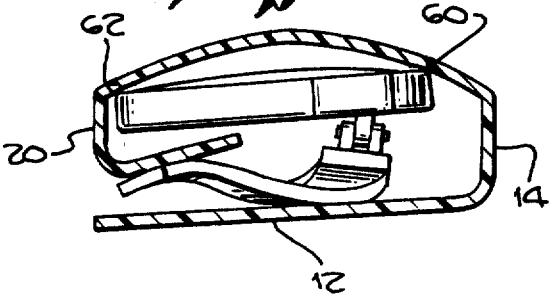
FIG. 4 is a cross-sectional view along line 4—4 of FIG. 3.

The proper insertion of the spectacle within the case 10 is disclosed in FIGS. 3 and 4. The spectacle is folded in the conventional fashion as though it were being inserted in an ordinary spectacle case. The spectacle is shown at 40. The left frame front 42 is movably attached to first temple 44 which terminates in tip 46. The right frame front 48 is movably attached to second temple 50 which terminates in tip 52. Bridge 54 connects the left frame front 42 to the right frame front 48. Left lens 56 is supported within left frame front 42 and right lens 58 is supported within right frame front 48. The spectacle 40 is inserted such that the frame fronts 42 and 48 and their respective lenses 56 and 58 lie within the upper portion of the spectacle case 10. Left frame front 42 touches arced upper surface 16 at point 60 and touches arched upper surface 18 at point 62. Right frame front 48 touches arced upper surface 16 at point 64 and touches arced upper surface 18 at point 66. These are the only points where the frame fronts 42 and 48 touch the upper surface of the spectacle case 10. As shown in FIG. 4, the upper surface of lenses 56 and 58 never come in contact with the spectacle case 10. As a result the problem of scratching the upper or exterior surface of the lenses is eliminated. In the case of spectacles which do not contain frame fronts, only a tiny portion of the lenses at points 60, 62, 64 and 66 touch the upper surface of the spectacle case and the problem of scratching the upper or exterior surface of the lenses is significantly reduced.

The spectacle 40 is further inserted such that each temple 44 and 50 and its respective tip 46 and 52 are placed below the inward extension 34 of the spectacle case 10. As a result, first temple tip 46 touches only the lower portion of inward extension 34 and second temple tip 52 touches only the lower portion of inward extension 34. Depending on the thickness of the spectacle, the inward portion of frame fronts 42 and 48 either touch the upper portion of inward extension 34 or do not touch anything at all. Temple tips 46 and 52 are prevented from coming into contact with the interior surface of lenses 56 and 58 by inward extension 34 of spectacle case 10. The temples 42 and 48 prevent the interior surface of lenses 56 and 58 from coming in contact with inward extension 34. As a result, the problem of scratching the lower or interior surface of the lenses is eliminated. In spectacles without frame fronts, only a tiny portion of each interior surface might touch the upper surface of inward extension 34. Usually, they will not touch at all. Therefore, the risk of scratching the interior surface of lenses for rimless glasses is significantly reduced.

Inward extension 34 is basically a partial separation wall which produces a large chamber 35 and the gap area 37. The large chamber 35 receives the frame front sections 42 and 48, the lenses 56 and 58, the bridge 54, the nose supports (not shown) and most of both temples 44 and 50. The gap area 37 receives a portion of both temples 44 and 50 and their respective tips 46 and 52.

Inward extension or partial separation wall 34 further serves to hold the spectacle 40 securely in place inside the spectacle case 10. If the gap 33 of the gap area 37 is approximately three thirty-seconds of an inch, a strong friction fit between temple tips 46 and 52 and the inward extension or partial separation wall 34 and base 12 is achieved. It is therefore important for the spectacle case 10 to be made of resilient material so that upon insertion of the spectacle into the spectacle case, the inward extension or partial separation wall 34 deflects away from the base 12 so as to frictionally retain the temples therein. As a result, the spectacle 40 is held firmly in place and no undue stress is placed on the bridge 54 and the adjacent nose supports (not shown). Therefore, the problem of placing undue stress on the bridge 54 and the nose supports is eliminated while the spectacle 40 is held firmly in place.

It is also important to note that the combination of the spectacles 40 and the spectacle case 10 act in a cooperative fashion to protect the spectacle from damage by either internal or external forces whereby the folded spectacle is positioned in said spectacle case 10 such that only the outer frame fronts 42 and 48 of the spectacle touch the third section (composed of first arced upper surface 16 and second arced upper surface 18 or alternatively as one convex surface) of the spectacle case 10, thereby protecting the exterior surfaces of the lenses 56 and 58. The spectacle 40 and spectacle case 10 further act in combination so that the temple tips 46 and 52 of the folded spectacle 40 fit snugly within the gap 37 first to securely hold the spectacle 40 in place and second so that the inward extension or partial separation wall 34 prevents the temple tips 46 and 52 from touching the interior surface of the lenses 56 and 58 thereby protecting them.

The spectacle case 10 can be manufactured from a rectangular sheet of material which is bent to form the sections as discussed above. The spectacle case 10 can also be formed as an extrusion.

Butyrate, out of which the spectacle case 10 is manufactured, can be easily extruded in sheets embodying the above design. Then all that need be done is to cut the Butyrate to appropriate lengths. In its natural form, Butyrate is transparent. It can be tinted with colors such as red, blue, gray, etc. to provide an opaque spectacle case 10. In an alternative embodiment shown in FIG. 5, a cover 70 can be placed around the exterior surface of the spectacle case 10, to provide a decorative opaque surface. The cover 70 can be permanently attached to the spectacle case 10 or can be removably attached to the spectacle case 10. The cover 70 can be any color, for example, blue, pink, smoke, gray, or red.

Figure 5:
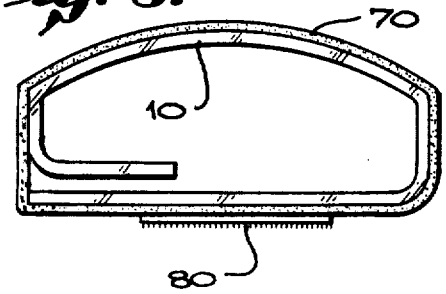
FIG. 5 is an end view of an alternative embodiment of the present invention.

The alternative embodiment shown in FIG. 5 also shows the arced upper surface as one continuous arc or convex surface instead of the double arc in the preferred embodiment shown in FIGS. 1 and 2. The radius of the single arc can be two and fifteen sixteenths inches.

In an additional alternative embodiment, an adhesive strip 80 can be placed on the lower portion of base 12 for a standard spectacle case 10 or on the lower portion of the cover 70 as shown in FIG. 5. The adhesive strip 80 can be made of material such as velcro and for example, can be two inches long by three quarters of an inch wide. By means of adhesive strip 80, the spectacle case 10 can be held in place on an appropriate surface that has a mating adhesive strip attached to it. For example, the spectacle case can thereby be firmly held in place on the dashboard or sunvisor of an automobile, on a night table next to a bed, or on a desk.

It is within the spirit and scope of the present invention to embody minor modifications in the design as disclosed above. The dimensions given for the spectacle case 10 as set forth above can also be slightly modified without departing from the spirit and scope of the present invention.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An improved spectacle case which is adapted to securely hold a spectacle within it to protect the spectacle from damage by either internal or external forces, wherein the improved spectacle case comprises:

a. a rectangular sheet member that is bent into five longitudinal sections with the fifth section partially overlapping the first section;

b. the first section forming a flat base which is wider than the vertical height of the frame front of a spectacle to be housed within said improved spectacle case;

c. the second section extending essentially perpendicular to said first section and having a height slightly less than the thickness of the spectacle when in its folded position;

d. the third section extending essentially perpendicular to said second section and generally parallel to said base, and being convexly curved in the direction away from said base;

e. the fourth section extending from said third section and parallel to said second section, but not extending to said base and leaving a gap therebetween; and f. the fifth section extending inwardly from said fourth section and parallel to said flat base, thereby forming a partial separation wall which partially separates the interior of the improved spectacle case into a chamber and a gap area;

g. wherein the partial separation wall produces a large chamber which is intended to receive the frame fronts, lenses, bridge, nose supports, and most of both temples of the spectacle, and a gap area which is intended to receive the tips of both temples and a portion of each temple of the spectacle.

2. The improved spectacle case as defined in claim 1 wherein the rectangular sheet member is of uniform thickness throughout.

3. The improved spectacle case as defined in claim 1 which is formed as an extrusion.

4. The improved spectacle case as defined in claim 1 wherein the rectangular sheet member is made of Butyrate.

5. The improved spectacle case as defined in claim 1 wherein the first section forms a flat base which is wider than the vertical height of the lens of a spectacle with frame fronts to be housed within said improved spectacle case.

6. The improved spectacle case as defined in claim 1 wherein the convexly curved third section is comprised of two separate equal arcs which join at the mid line of the third section.

7. The improved spectacle case as defined in claim 1 which is fitted with an opaque cover that encircles the five longitudinal sections.

8. The improved spectacle case as defined in claim 1 wherein an adhesive strip is attached to the exterior surface of said flat base, to permit removable attachment of the spectacle case to a supporting surface.

9. The improved spectacle case as defined in claim 8 wherein an adhesive strip is attached to said opaque cover in the region which encircles the flat base, to permit removable attachment of the spectacle case to a supporting surface.

10. The improved spectacle case as defined in claim 1 wherein said gap between the partial separation wall and the flat base is approximately three thirty-seconds of an inch in thickness.

11. The improved spectacle case as defined in claim 1 which is made of resilient material so that upon insertion of a spectacle therein, said partial separation wall deflects away from said base so as to frictionally retain the temples therebetween.

12. The combination of a spectacle and a spectacle case wherein the spectacle case is of an improved construction to protect the spectacle from damage by either internal or external forces, said combination comprising:

a. the improved spectacle case comprising a rectangular sheet member that is bent into five longitudinal sections with the fifth section partially overlapping the first section, the first section forming a flat base which is wider than the vertical height of the rim of a spectacle to be housed within the spectacle case, the second section extending essentially perpendicular to the first section and having a height slightly less than the thickness of the spectacle when in its folded position, the third section extending essentially perpendicular to the second section and generally parallel to the base and being convexly curved in the direction away from said base, the fourth section extending from the third section and parallel to the second section but not extending to the base and leaving a gap therebetween, and the fifth section extending inwardly from the fourth section and parallel to the flat base thereby forming a partial separation wall which partially separates the interior of the spectacle case into two chambers; and b. the spectacle being inserted in the spectacle case such that the rims, lenses, bridge, nose supports, and most of both temples of the spectacle lie within the large chamber, and the tips of both temples and a part of both temples lie within the smaller gap between the partial separation wall and the base;

c. whereby the folded spectacle is positioned in said spectacle case such that only the outer rims of the spectacle touch said third section thereby protecting the exterior surface of the lenses, and the temples of the folded spectacle fit snugly within said gap first to securely hold the spectacle in place and second so that said partial separation wall prevents the temples from touching the interior surface of the lenses thereby protecting them.

13. The improved spectacle case as defined in claim 1 wherein the rectangular sheet member is made of Polycarbonate.

14. An improved spectacle case which is adapted to hold a folded spectacle in a fully protected condition, wherein the improved spectacle case comprises:

a. a rectangular sheet member that is bent into the shape of a house containing a first section forming a flat base which is wider than the vertical height of the frame front of a spectacle to be housed within the spectacle case, a second section extending essentially perpendicular to the first section and having a height slightly less than the thickness of the spectacle when in its folded position within the spectacle case, a third section extending essentially perpendicular to the second section and generally parallel to the base and being convexly curved in the direction away from the base, a fourth section extending from the third section and parallel to the second section but not extending to the base and leaving a gap therebetween, and a fifth section extending inwardly from the fourth section and parallel to the flat base thereby forming a partial separation wall which partially separates the interior of the spectacle case into a chamber and a gap area;

b. wherein the design in the shape of a house provides the spectacle case with an inherent strength to fully protect the spectacle within if the spectacle case is dropped, stepped on, or sat upon.

15. The invention as defined in claim 14 wherein said spectacle case is made of Butyrate which further adds to the strength of the spectacle case to protect the spectacle within if the spectacle case is dropped, stepped on or sat upon.

16. The invention as defined in claim 14 wherein said spectacle case is made of Polycarbonate which further adds to the strength of the spectacle case to protect the spectacle within if the spectacle case is dropped, stepped on or sat upon.

17. An improved spectacle case which is adapted to securely hold a spectacle within it to protect the spectacle from damage by either internal or external forces, wherein the improved spectacle case comprises:

a. a horizontal base;

b. a first vertical wall integrally formed with said horizontal base and curvidly extending therefrom;

c. a first arced upper surface integrally formed with said first vertical wall and extending from the uppermost portion of said first vertical wall to the central and uppermost plane of said spectacle case;

d. a second arced upper surface integrally formed with said first arced upper surface and extending from said uppermost plane of said spectacle case to the plane parallel with the uppermost portion of said first vertical wall;

e. a second vertical wall integrally formed with said second arced upper surface and extending downwardly to a height above said base, thereby leaving a gap;

f. an inwardly extending portion integrally formed with said second vertical wall and curvidly extending from the lowermost portion of said second vertical wall toward the center of said spectacle case for a distance less than one half the width of the spectacle case and parallel to said base, thereby forming a gap between the inwardly extending portion and said horizontal base; and g. said horizontal base, said first vertical wall, said first upper arced surface, said second upper arced surface, said second vertical wall and said inwardly extending portion all extending laterally for an equal distance to form a one piece spectacle case;

h. whereby a folded spectacle may be inserted into said spectacle case such that only the outer rims of the spectacle touch said first and said second arced upper surfaces thereby protecting the exterior surface of the lenses, and the temples of the folded spectacle fit snugly within said gap area between said inwardly extending portion and said horizontal base to first hold the spectacle in place and secondly whereby said inwardly extending portion prevents the temples from touching the interior surface of the lenses in said spectacle.

18. The improved spectacle case a defined in claim 17 wherein the horizontal base, the first vertical wall, the first arced upper surface, the second arced upper surface, the second vertical wall and the inwardly extending portion are of uniform thickness.

19. The improved spectacle case as defined in claim 17 which is made of Butyrate.

20. The improved spectacle case as defined in claim 17 wherein said improved spectacle case is fitted with an opaque cover which encircles the horizontal base, the first vertical wall, the first arced upper surface, the second arced upper surface, the second vertical wall and the inwardly extending portion.

21. The improved spectacle case as defined in claim 17 wherein an adhesive strip is attached to the exterior surface of said horizontal base, to permit removable attachment of the spectacle case to a supporting surface.

22. The improved spectacle case as defined in claim 20 wherein an adhesive strip is attached to said opaque cover in the region which encircles said horizontal base, to permit removable attachment of the spectacle case to a supporting surface.

23. The improved spectacle case as defined in claim 17 wherein said gap between the inwardly extending portion and the horizontal base is approximately three thirty-seconds of an inch in thickness.

24. The improved spectacle case as defined in claim 17 which is made of resilient material so that upon insertion of a spectacle therein, said inwardly extending portion deflects away from said horizontal base so as to frictionally retain the temples therebetween.

25. The improved spectacle case as defined in claim 17 which is made of Polycarbonate.

* * * * *